US008348210B1

(12) United States Patent
Lee

(10) Patent No.: US 8,348,210 B1
(45) Date of Patent: Jan. 8, 2013

(54) POSITIONING DEVICE FOR SHELVES

(76) Inventor: Chia-Hung Lee, Taichung (TW)

( * ) Notice: Subject to any disclaimer, the term of this patent is extended or adjusted under 35 U.S.C. 154(b) by 0 days.

(21) Appl. No.: 13/306,725

(22) Filed: Nov. 29, 2011

(51) Int. Cl.
*E04G 3/20* (2006.01)

(52) U.S. Cl. ..... 248/235; 248/220.31; 248/224.7

(58) Field of Classification Search ..... 248/235, 248/220.22, 220.31, 221.11, 222.51, 225.21, 248/250, 224.7
See application file for complete search history.

(56) References Cited

U.S. PATENT DOCUMENTS 3,579,711 A * 5/1971 Nicolin ..... 220/759
4,779,830 A * 10/1988 Phelps ..... 248/250
6,085,916 A * 7/2000 Kovacevic et al. ..... 211/86.01
6,182,937 B1 * 2/2001 Sanderse ..... 248/466
6,574,924 B2 * 6/2003 Maniezzo ..... 52/36.4
6,631,813 B1 * 10/2003 Walter et al. ..... 211/94.01
7,866,492 B2 * 1/2011 Walter ..... 211/103
8,128,043 B2 * 3/2012 Walter ..... 248/224.7
2008/0217271 A1 * 9/2008 Walter ..... 211/89.01
2009/0166491 A1 * 7/2009 Walter ..... 248/220.31
2010/0102186 A1 * 4/2010 Keyvanloo ..... 248/224.7

* cited by examiner

*Primary Examiner* — Anita M King

(57) ABSTRACT

A positioning device for shelves includes a support and a sleeve, the support has a first end and a second end. A tail board extends from the first end and a notch is defined in the tail board. The sleeve has a passage defined axially therethrough and at least one stop extends inward from the inner periphery of the passage. The tail board is inserted into the passage and the stop is engaged with the notch so as to secure the support to the passage. An engaging portion is located in the notch and located corresponding to the stop.

3 Claims, 8 Drawing Sheets

POSITIONING DEVICE FOR SHELVES

FIELD OF THE INVENTION

The present invention relates to a positioning device, and more particularly, to a positioning device for shelves which is easily installed and removed.

BACKGROUND OF THE INVENTION

A conventional display rack 5 is shown in FIG. 10 and generally includes a post 51 with multiple supports 52 and display boards 53, wherein the post 51 has multiple holes 511 so that the supports 52 can be positioned at desired holes 511. FIG. 11 shows that the supports 52 each have multiple hooking portions 521 defined in the underside of one end thereof and each hooking portion 521 has a notch 522 defined in an inside thereof. The supports 52 are engaged with the holes 511 of the post 51. The supports 52 each have a reception slot 523 in which an adjusting member 6 is received so as to urge the support 52 to the post 51.

However, the hooking portions 521 of the supports 52 are not secured in the holes 511 and the assemblers have to rotate the adjusting members 6 to secure the hooking portions 521. Therefore, the assembling processes are prolonged and the cost is increased.

FIG. 12 shows another conventional display rack, wherein the display board 3 has holes 31 and each hole 31 has a sleeve 7 securely received therein by a plastic nut 8. The sleeve 7 has a passage 71 so as to receive a support 9. The support 9 has an engaging portion 91 extending upward from an end thereof so that when the support 9 is inserted into the passage 71, the support 9 has to be tilted an angle until the engaging portion 91 extends beyond the passage 71. The support 9 is then positioned horizontally to hook the engaging portion 91 to the outer face of the sleeve 7 to restrict the horizontal movement of the support 9. Products to be displayed can be hanged to the front end of the support 9.

As shown in FIG. 13, when the support 9 is pushed upward and the engaging portion 91 is removed from the end face of the sleeve 7, the support 9 is easily removed from the passage 71 and drops to the floor. This is because the support 9 is pivoted by the upward force the engaging portion 91 no longer contacts the end face of the sleeve 7. This happens often when the customers re-hang the products back to the support 9.

For the first conventional example, the supports 52 each have multiple hooking portions 521 in the underside thereof and each hooking portion 521 has a notch 522 defined in the inside thereof. The supports 52 are engaged with the holes 511 of the post 51. The supports 52 each have an adjusting member 6 to secure the support 52 to the post 51. This requires a lot of assembling time and the manufacturing cost is high. The second conventional example, when the support 9 is pivoted by the upward force, the engaging portion 91 no longer contacts the end face of the sleeve 7 and the support 9 drops to the floor. This happens often when the customers re-hang the products back to the support 9 and couch the support 9.

SUMMARY OF THE INVENTION

The present invention relates to a positioning device for shelves and comprises a support and a sleeve. The support has a first end and a second end. A tail board extends from the first end and a notch is defined in the tail board. The sleeve has a passage defined axially therethrough and at least one stop extends inward from the inner periphery of the passage. The tail board is inserted into the passage and the stop is engaged with the notch so as to secure the support to the passage.

Preferably, an engaging portion is located in the notch and located corresponding to the stop.

The primary object of the present invention is to provide a positioning device which is easily assembled and separated without requirement of special-trained persons.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
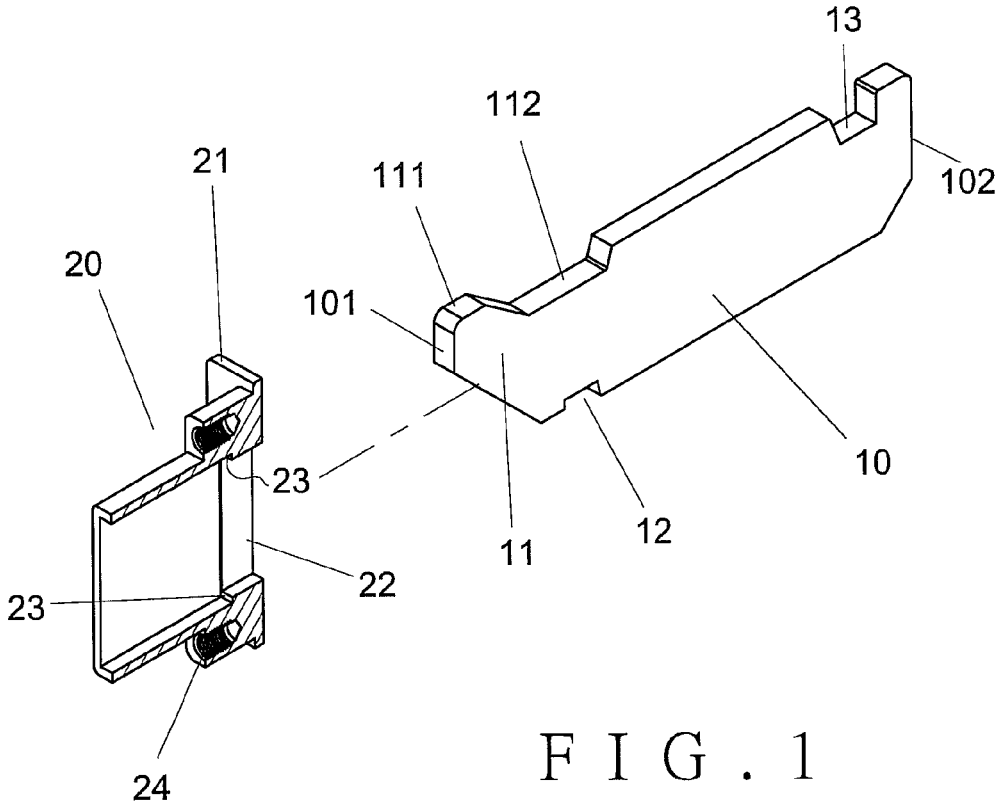
FIG. 1 is an exploded view to show the positioning device of the present invention.
Figure 2:
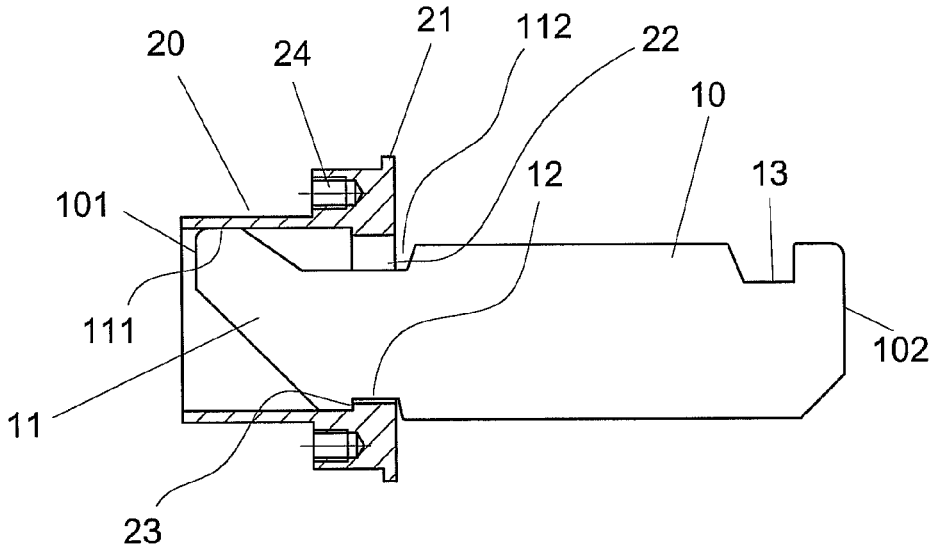
FIG. 2 is a cross sectional view to show the connection of the support and the sleeve of the positioning device of the present invention.

Referring to FIGS. 1 and 2, the positioning device for shelves comprises a support 10 and a sleeve 20, wherein the support 10 is a board like member and has a first end 101 and a second end 102 which is located corresponding to the first end 101. A tail board 11 extends from the first end 101 and has a contact face 111. A recess 112 is defined in the top of the tail board 11. A first notch 12 is defined in the underside of the tail board 11 and a second notch 13 is defined in the top of the second end 102 of the support 10.

The sleeve 20 has a flange 21 at the front end thereof and a stepped body extends from the flange 21 and toward the rear end of the sleeve 20. A passage 22 is defined axially through the sleeve 20 and a stop 23 extends inward from the inner periphery of the passage 22. The stepped body on the flange 21 has threaded holes 24.

Figure 3:
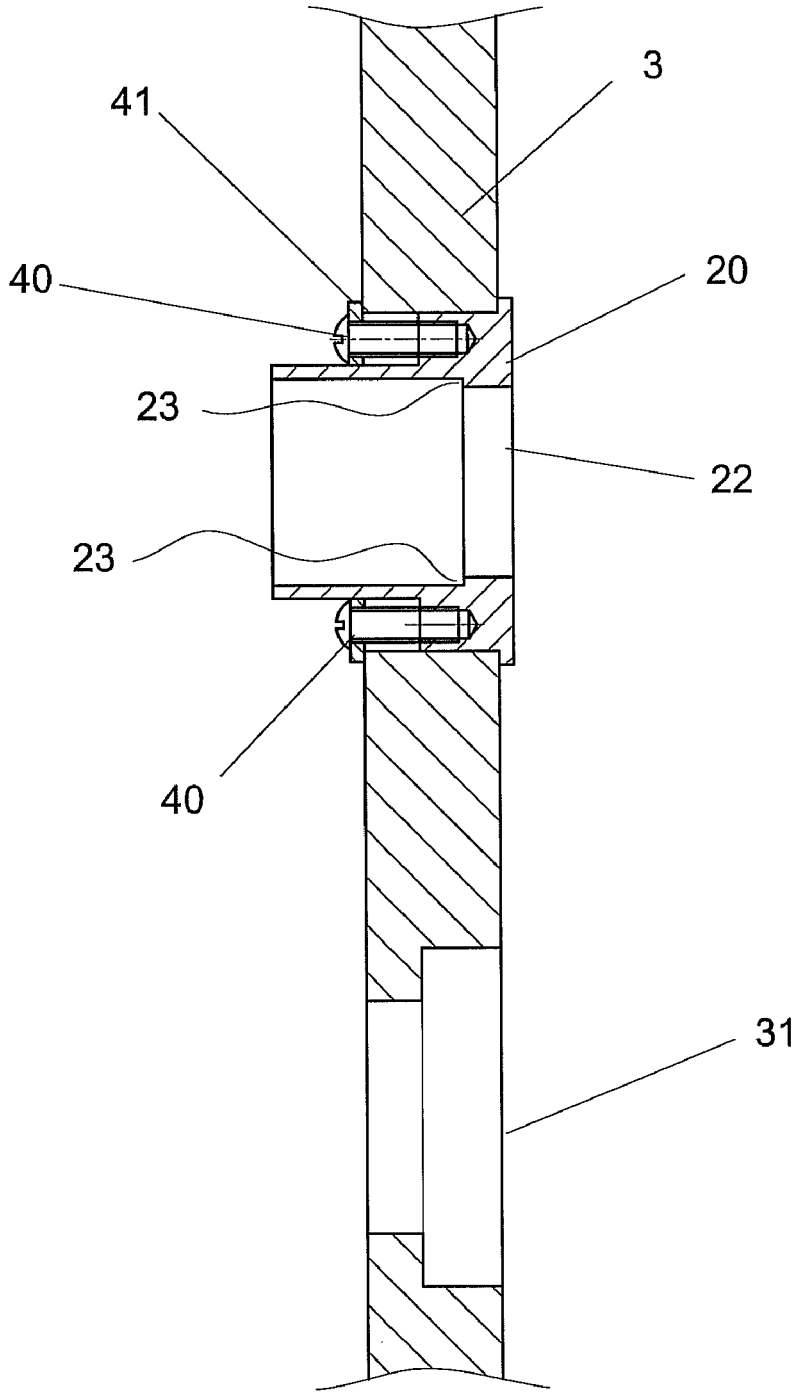
FIG. 3 is a cross sectional view to show the connection of the sleeve of the positioning device of the present invention and the display board.
Figure 4:
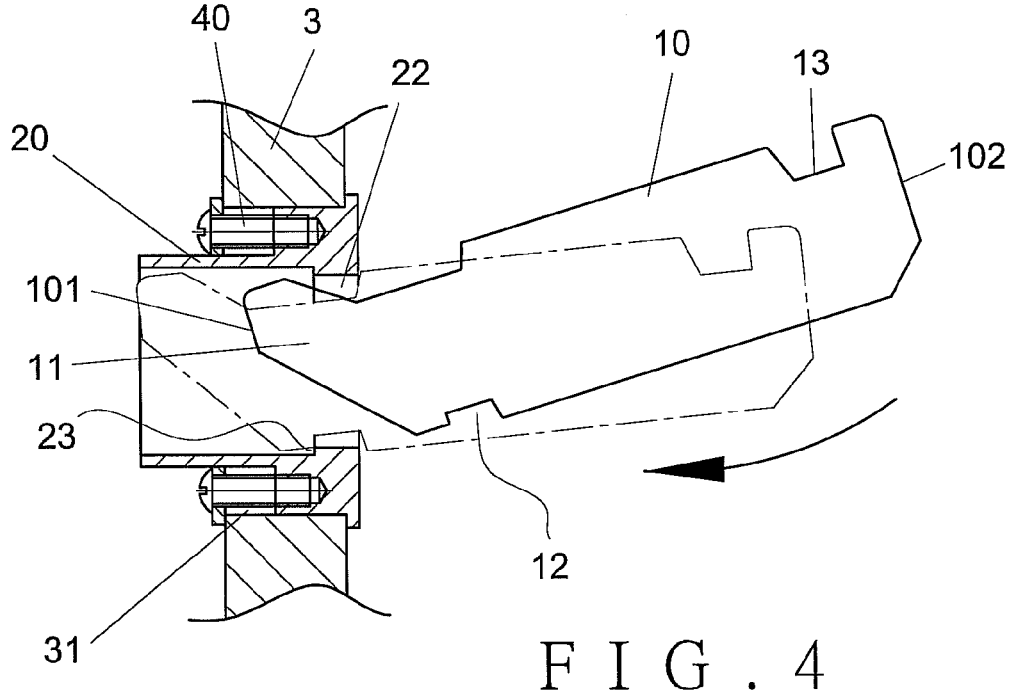
FIG. 4 shows the way of installation of the support to the sleeve.

Referring to FIGS. 2 and 3, the sleeve 20 is located in the holes 31 of the display board 3 and bolts 40 threadedly extend through the threaded holes 24 and are cooperated with washers 41 to fix the sleeve 20 to the display board 3. As shown in FIG. 4, the support 10 is slightly inclined and the tail board 11 is inserted into the passage 22, and the support 10 is then positioned horizontally by engaging the stop 23 with the first notch 12. The first notch 12 of the tail board 11 is restricted by the stop 23 and cannot be removed from the passage 22 to quickly position the support 10 to the passage 22 of the sleeve 20.

Figure 5:
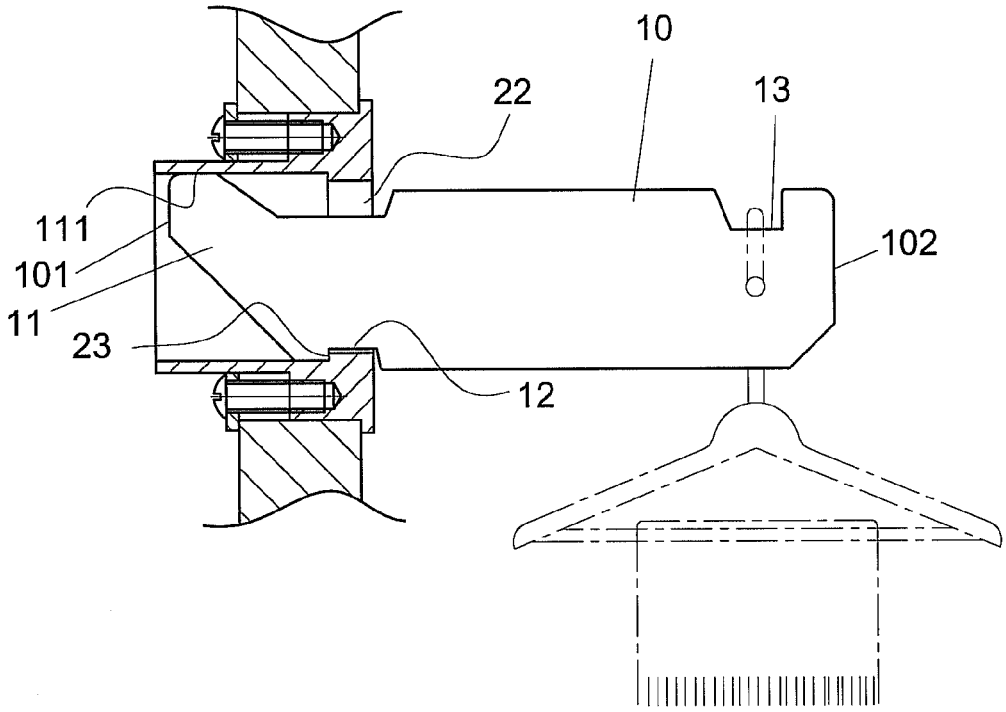
FIG. 5 shows a product is hanged on the support which is secured to the sleeve of the display board.

Referring to FIG. 5, the contact face 111 of the tail board 11 is restricted by the inner periphery of the passage 22, the stop 23 of the passage 22 and the first notch 12, so that the support 10 is not disengaged from the passage 22 when a load such as the product hanged in the second notch 13 of the second end 102 of the support 10.

Figure 6:
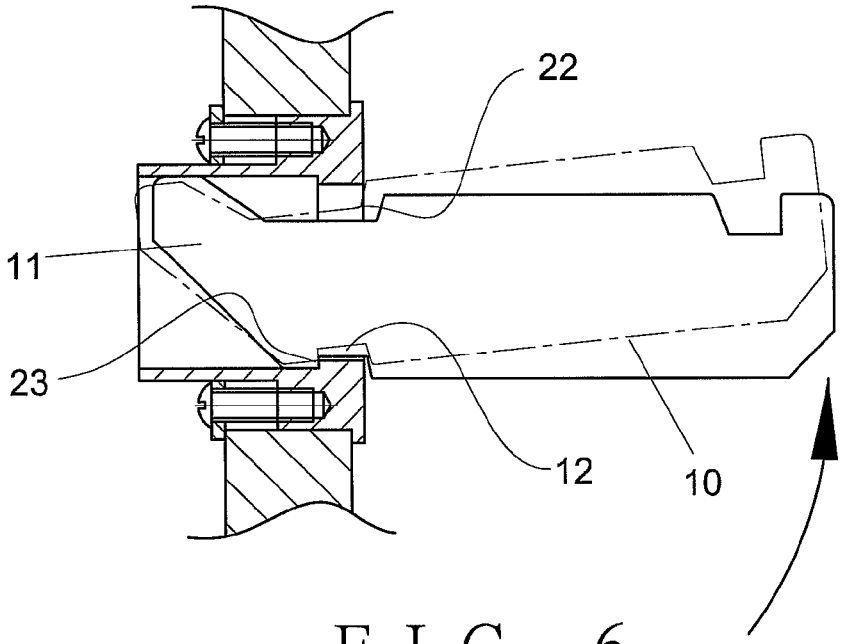
FIG. 6 shows that the support is pivoted upward.

Referring to FIG. 6, when the support 10 is pivoted upward by an upward force or even the support 10 is pivoted to its extreme limit, the recess 112 of the tail board 11 is restricted by the opening of the passage 22, and the first notch 12 is restricted by the stop 23 in the passage 22, so that the support 10 is restricted on the top and on the underside, the support 10 is not disengaged from the sleeve 20.

Figure 7:
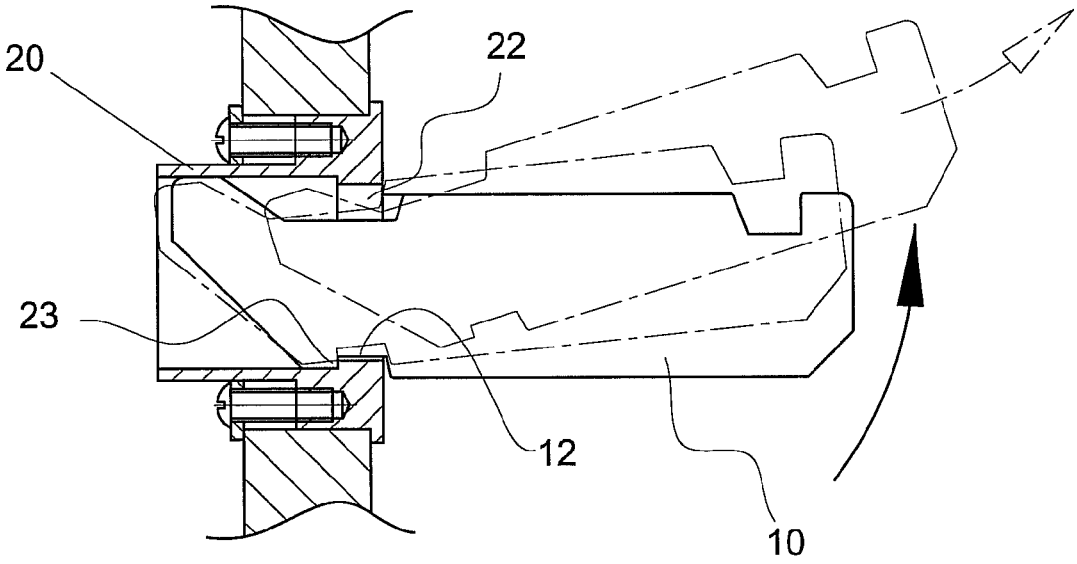
FIG. 7 shows that the support is removed from the sleeve.

Referring to FIG. 7, when removing the support 10 from the sleeve 20, the support 10 is lifted an angle which is in the range 6 degrees±1 degree (the angle may be varied according the shape of the support 10). The first notch 12 is disengaged from the stop 23 in the passage 22 of the sleeve 20 and the support 10 is able to be removed from the passage 22. Due to the limited angle that the support 10 can be removed from the sleeve 20, the support 10 is not disengaged from the sleeve 20 by minor impact. Only the specific angle is pivoted for the support 10, the support 10 can be removed from the passage 22 of the sleeve 20. Therefore, the support 10 is secured and safe.

Figure 8:
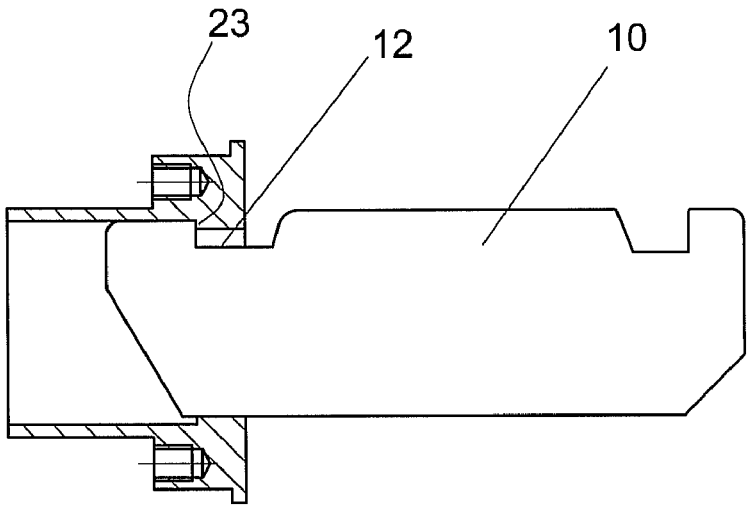
FIG. 8 shows another embodiment of the support wherein the first notch is located on the top of the support.

Referring to FIG. 8 which shows another embodiment, wherein the first notch 12 is located on the top of the support 10 and is cooperated with the stop 23. The first notch 12 is restricted by the stop 23 to restrict the horizontally movement so that the support 10 is secured wherever the first notch 12 is located on the top or the underside of the support 10.

Figure 9:
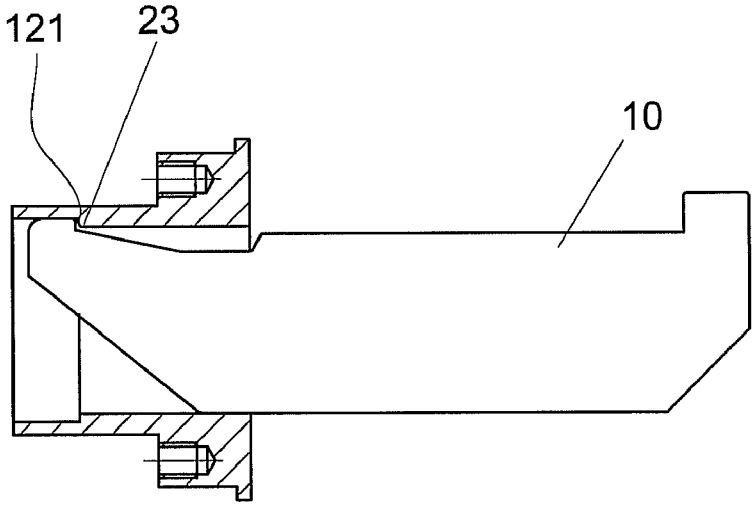
FIG. 9 shows yet another embodiment of the support.
Figure 10:
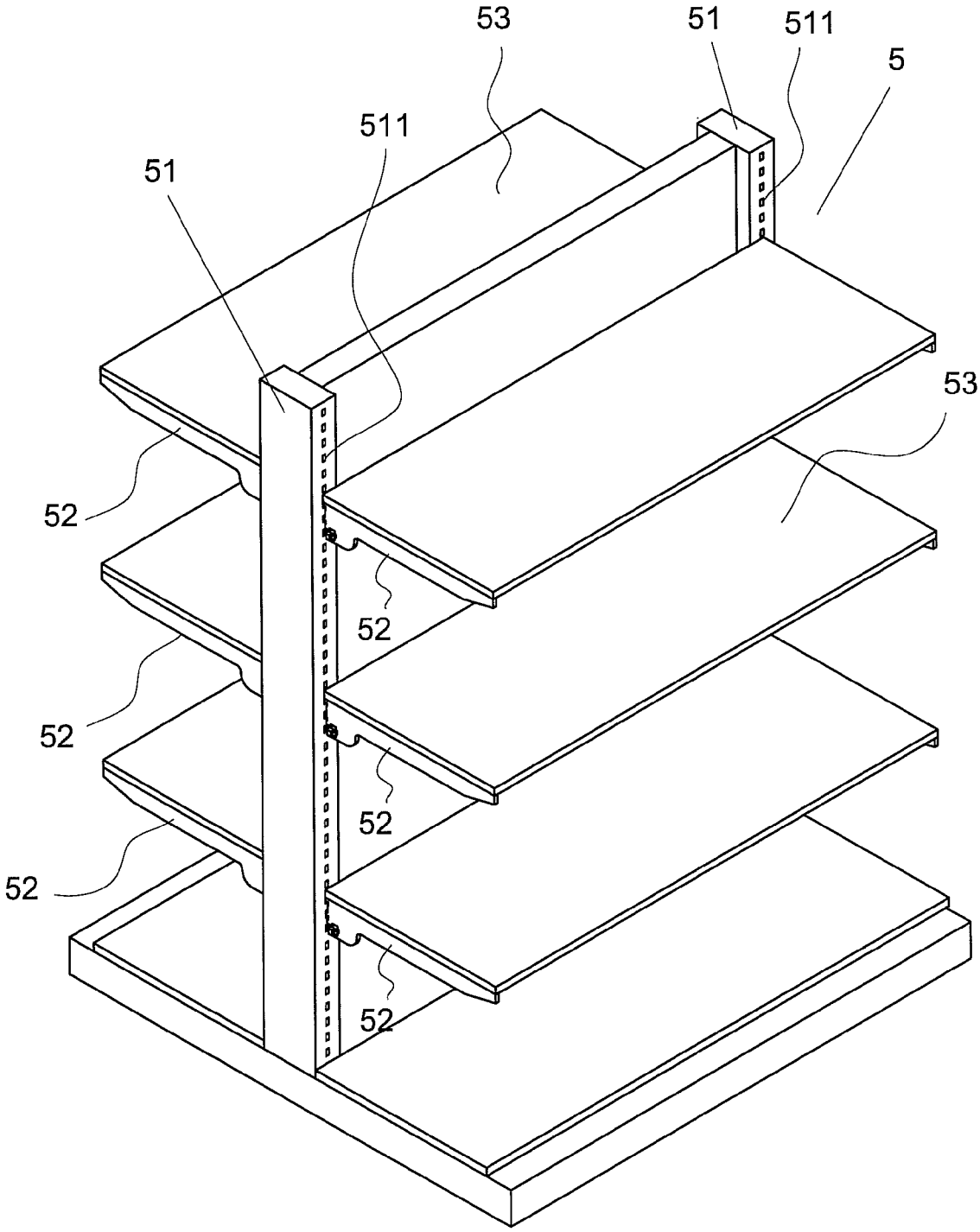
F I G . 10 (PRIOR ART)
FIG. 10 shows the conventional display board.
Figure 11:
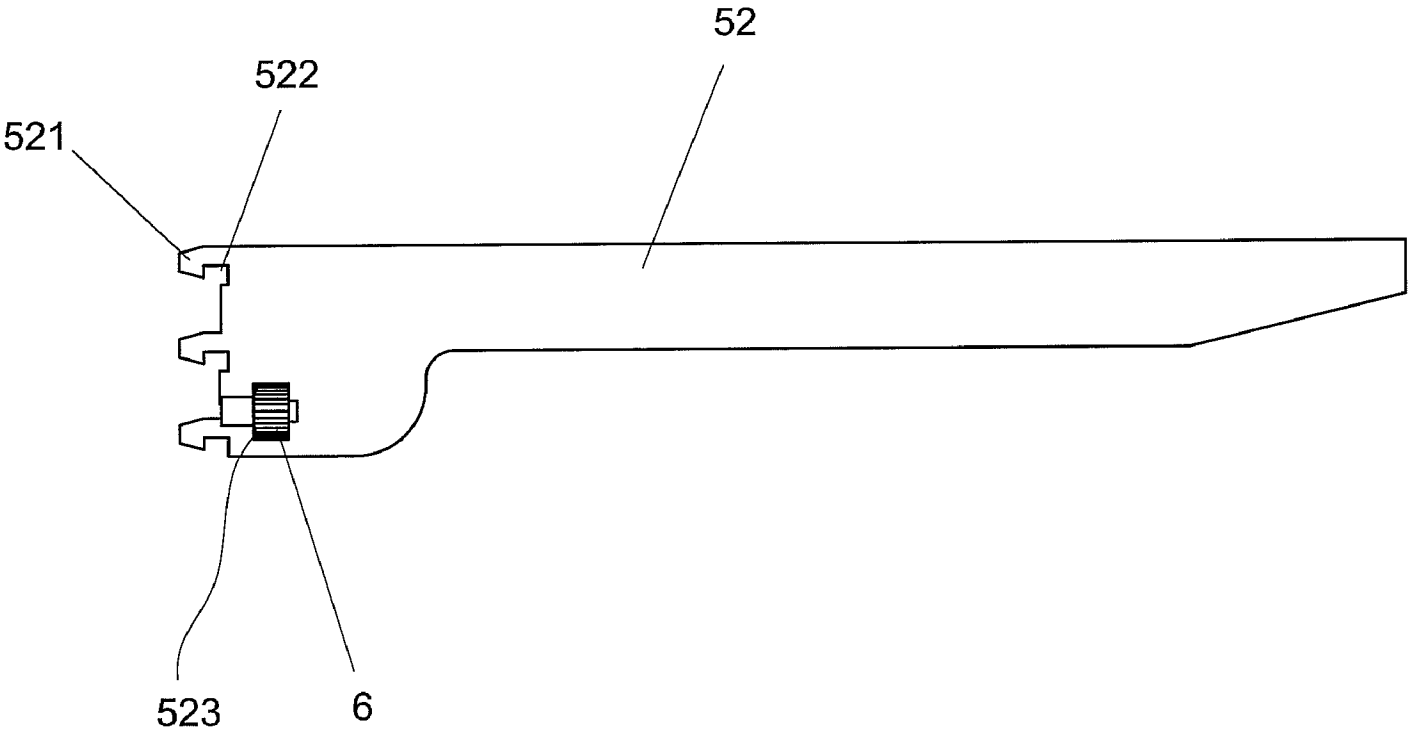
FIG. 11 (PRIOR ART)
FIG. 11 shows the conventional support.
Figure 12:
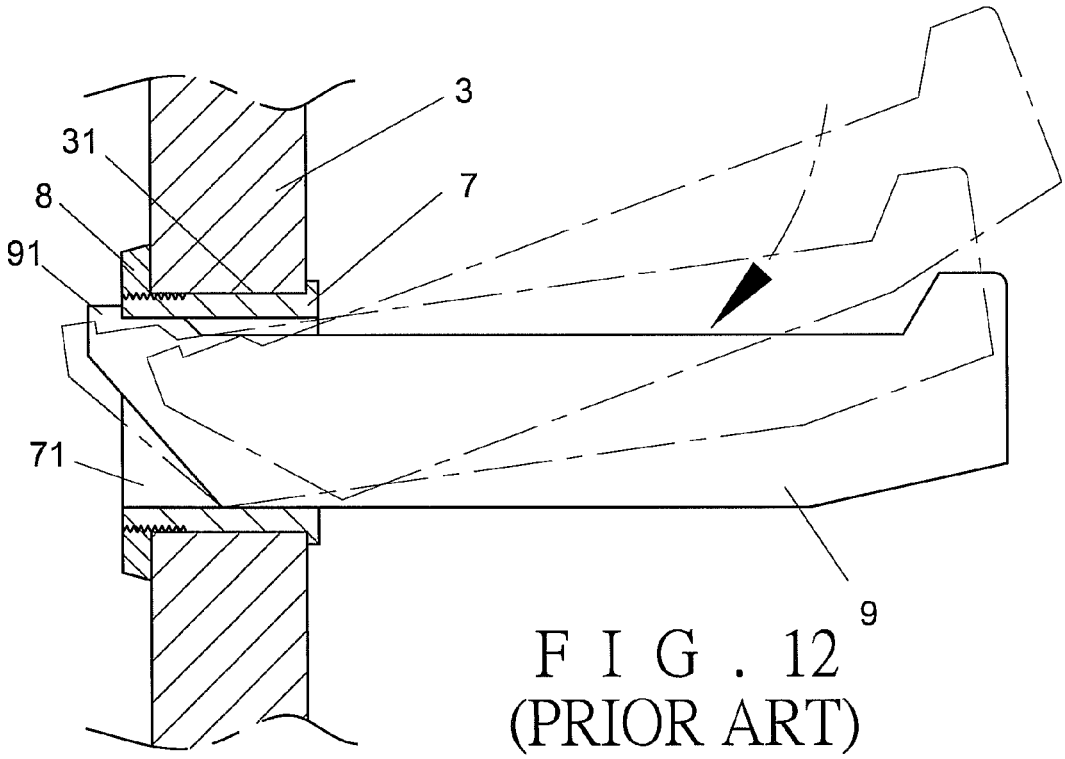
FIG. 12 (PRIOR ART)
FIG. 12 shows the conventional support is inserted into the passage of the sleeve.
Figure 13:
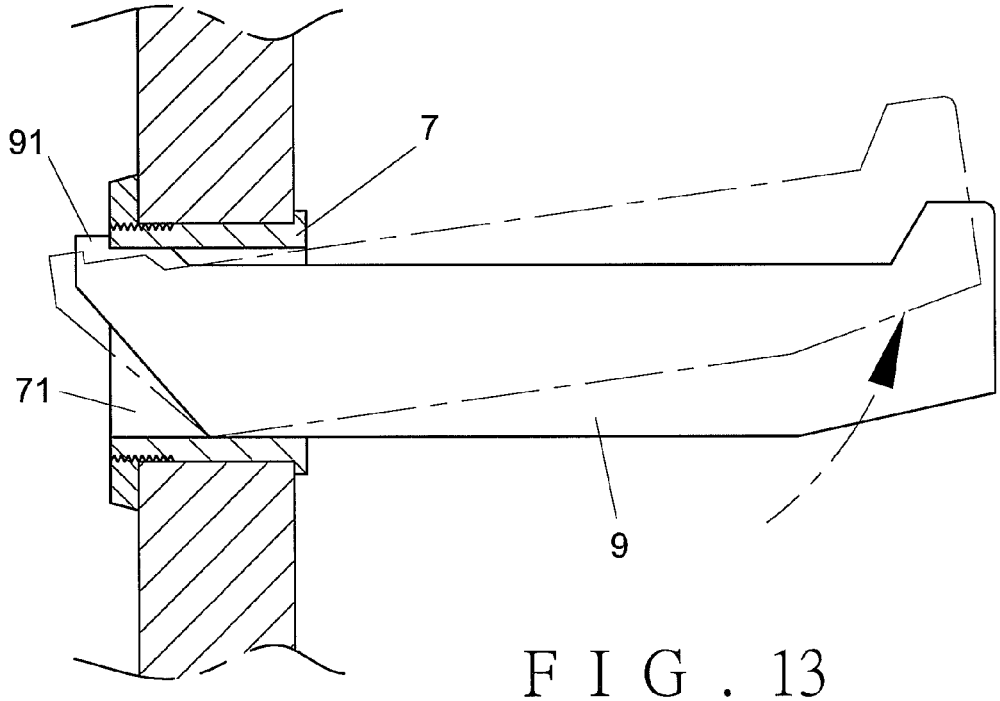
FIG. 13 (PRIOR ART)
FIG. 13 shows that the conventional support is pivoted upward.

Referring to FIG. 9 which shows yet another embodiment, wherein an engaging portion 121 is located in the first notch 12 and the position of the stop 23 in the sleeve 20 is located close to the rear end of the sleeve 20. The engaging portion 121 is located corresponding to the stop 23 so as to restrict the horizontal movement of the support 10 and the support 10 can be easily installed and removed.

While we have shown and described the embodiment in accordance with the present invention, it should be clear to those skilled in the art that further embodiments may be made without departing from the scope of the present invention.

What is claimed is:

1. A positioning device for shelves, comprising:

a support, being a longitudinal board with an upside and a downside, having a first end, a second end, a first notch on the downside near the first end, a recess on the upside near the first end, a second notch on the upside near the second end, and a tail board defined among the first end, the recess and the second notch inclining towards one side of the support, wherein the recess is different from the first notch in shape; and a sleeve having a passage defined axially therethrough and at least one step formed on one of two opposite sides of the passage and corresponding to the first notch in shape, wherein when the tail board is inserted into the passage, the step will engage with the first notch so as to secure the support into the passage.

2. The positioning device as claimed in claim 1, wherein the at least one step is two in number, and the two steps are separately formed on the two opposite sides of the passage.

3. The positioning device as claimed in claim 2, wherein the recess is formed with an engaging portion corresponding to the other one of the two steps in shape.

* * * * *